US008287314B1

(12) United States Patent
Gao et al.

(10) Patent No.: US 8,287,314 B1
(45) Date of Patent: Oct. 16, 2012

(54) AUDIO JACK CONNECTOR

(75) Inventors: Lei Gao, Guang-Dong (CN); Yin-Lung Wu, New Taipei (TW); Bing-Tao Yang, Guang-Dong (CN); Ming-Chiang Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/197,726

(22) Filed: Aug. 3, 2011

(51) Int. Cl.
*H01R 24/04* (2006.01)

(52) U.S. Cl. ..... 439/668

(58) Field of Classification Search ..... 439/668, 439/607.4

See application file for complete search history.

(56) References Cited

U.S. PATENT DOCUMENTS

| | | | | |
|---|---|---|---|---|
| 4,037,913 | A * | 7/1977 | Deitch et al. | 439/668 |
| 5,934,924 | A * | 8/1999 | Suzuki | 439/318 |
| 6,368,156 | B1 * | 4/2002 | Lin | 439/668 |
| 6,471,546 | B1 * | 10/2002 | Zhu et al. | 439/607.4 |
| 6,478,629 | B1 * | 11/2002 | Li et al. | 439/668 |
| 6,676,451 | B2 * | 1/2004 | Suzuki et al. | 439/668 |
| 6,690,801 | B2 * | 2/2004 | Yeh | 381/77 |
| 6,761,593 | B2 * | 7/2004 | Hu | 439/668 |
| 7,044,804 | B2 * | 5/2006 | Han et al. | 439/668 |
| 7,316,587 | B2 * | 1/2008 | Chien et al. | 439/668 |
| 7,318,753 | B2 * | 1/2008 | Chung et al. | 439/668 |
| 7,387,543 | B1 * | 6/2008 | Wu et al. | 439/668 |
| 7,604,513 | B2 * | 10/2009 | Wang et al. | 439/668 |
| 7,645,170 | B2 * | 1/2010 | Long et al. | 439/668 |
| 7,648,400 | B2 * | 1/2010 | Zhu et al. | 439/668 |
| 7,753,738 | B2 * | 7/2010 | Zhang | 439/668 |
| 7,789,712 | B1 * | 9/2010 | Peng et al. | 439/668 |
| 7,794,285 | B1 * | 9/2010 | Huang | 439/668 |
| 7,887,376 | B1 * | 2/2011 | Zhang et al. | 439/668 |
| 7,963,807 | B1 * | 6/2011 | Yang | 439/668 |
| D644,183 | S * | 8/2011 | Gao et al. | D13/147 |
| 2007/0249235 | A1 * | 10/2007 | Wu | 439/668 |

* cited by examiner

*Primary Examiner* — Amy Cohen Johnson
*Assistant Examiner* — Vladimir Imas
(74) *Attorney, Agent, or Firm* — Cheng-Ju Chiang

(57) ABSTRACT

An audio jack connector includes an insulating housing, signal terminals and a ground terminal. The insulating housing defines an insertion hole extending longitudinally to penetrate through a front of the insulating housing, a fastening groove and a gap communicating with the insertion hole. The signal terminals are disposed at regular intervals between one side surface and the insertion hole of the insulating housing. The ground terminal has a base plate vertically fastened in one side surface of the insulating housing, a soldering arm projected under a bottom surface, a fastening plate bent from a top of the base plate, an elastic plate extending forward from the fastening plate and a contact arm formed by a front end of the elastic plate arched downward. The fastening plate and the elastic plate are disposed in the fastening groove with the contact arm stretched into the insertion hole through the gap.

8 Claims, 8 Drawing Sheets

AUDIO JACK CONNECTOR

BACKGROUND OF THE INVENTION

1. Field of the Invention

The present invention relates to an audio jack connector, and more particularly to an audio jack connector capable of engaging with an audio plug connector steadily.

2. The Related Art

Generally, audio jack connectors are widely used in variety of electronic apparatuses, such as MP3/MP4, mobile phones, computers and other equipments. With fast development of information, communication, photoelectric and consumer electronics industry, most of the electronic apparatuses provide multimedia video and audio functions. So request of the audio jack connector used in the electronic apparatus is higher.

A conventional audio jack connector includes an insulating housing and a plurality of terminals assembled in the insulating housing. The insulating housing defines an insertion hole for receiving an audio plug connector therein. The terminals include a plurality of signal terminals, a ground terminal, and a switch terminal assembly. The ground terminal has a base portion, a contact portion and a soldering portion extended from the base portion. The insulating housing defines a plurality of terminal grooves communicating with the insertion hole. The base portion of the ground terminal is received in one of the terminal grooves with the contact portion stretching into the insertion hole to connect with the audio plug connector and the soldering portion connected with a printed circuit board used in the conventional audio jack connector. The ground terminal has not only a ground function, but also an antenna function that requests the ground terminal to have a lower impedance and higher steadiness. In order to lower the impedance of the ground terminal, a common way of doing that is to increase area of the ground terminal.

However, when the area of the ground terminal is increased, the occupied space of the conventional audio jack connector in the electronic product is increased accordingly. Furthermore, the conventional audio jack connector is fastened in the electronic product inconveniently and unsteadily.

SUMMARY OF THE INVENTION

It is an object of the present invention to provide an audio jack connector adapted to be electrically connected with a printed circuit board and engaged with an audio plug connector. The audio jack connector includes an insulating housing, a plurality of signal terminals and a ground terminal. The insulating housing has a top surface, a front surface, a rear surface, a bottom surface and two side surfaces. The insulating housing defines an insertion hole extending along an inserting direction of the audio plug connector to penetrate through the front surface and a fastening groove opened in the top surface. A front of a bottom side of the fastening groove defines a gap communicating with the insertion hole. The signal terminals are disposed at regular intervals between one of the side surfaces and the insertion hole of the insulating housing along the inserting direction of the audio plug connector, and each has one end stretched into the insertion hole to contact the audio plug connector and the other end suspended under the bottom surface of the insulating housing to be connected with the printed circuit board. The ground terminal has a base plate vertically fastened in one side surface of the insulating housing. A bottom edge of the base plate extending sideward and inclined downward to form a soldering arm projected under the bottom surface to be connected with the printed circuit board. A top edge of the base plate bent sideward to form a fastening plate of which a front edge extends forward to form an elastic plate having a front end thereof arched downward to form a contact arm. The fastening plate and the elastic plate are disposed in the fastening groove with the contact arm stretched into the insertion hole through the gap to contact the audio plug connector.

As described above, the signal terminals and the ground terminal are arranged in a periphery portion of the insulating housing to make the audio jack connector have a compact structure and occupy a small space. Furthermore, the design of the ground terminal realizes lower impedance and higher steadiness, and a smaller space of the ground terminal occupying in the insulating housing.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
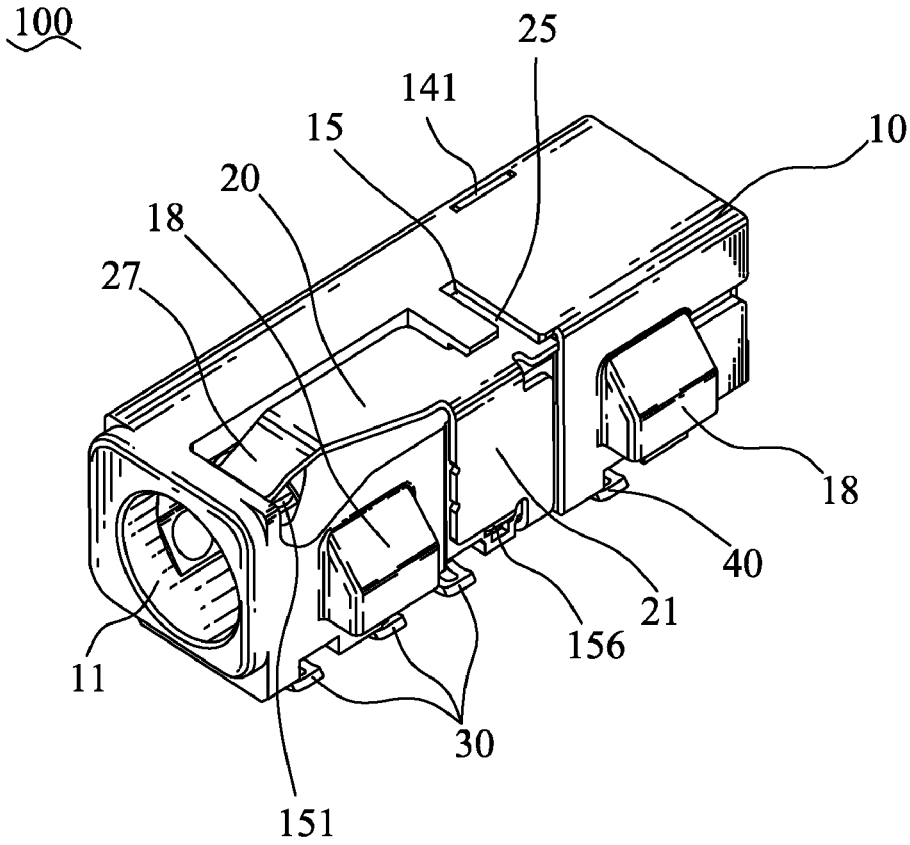
FIG. 1 is a perspective view of an audio jack connector in accordance with the present invention.
Figure 2:
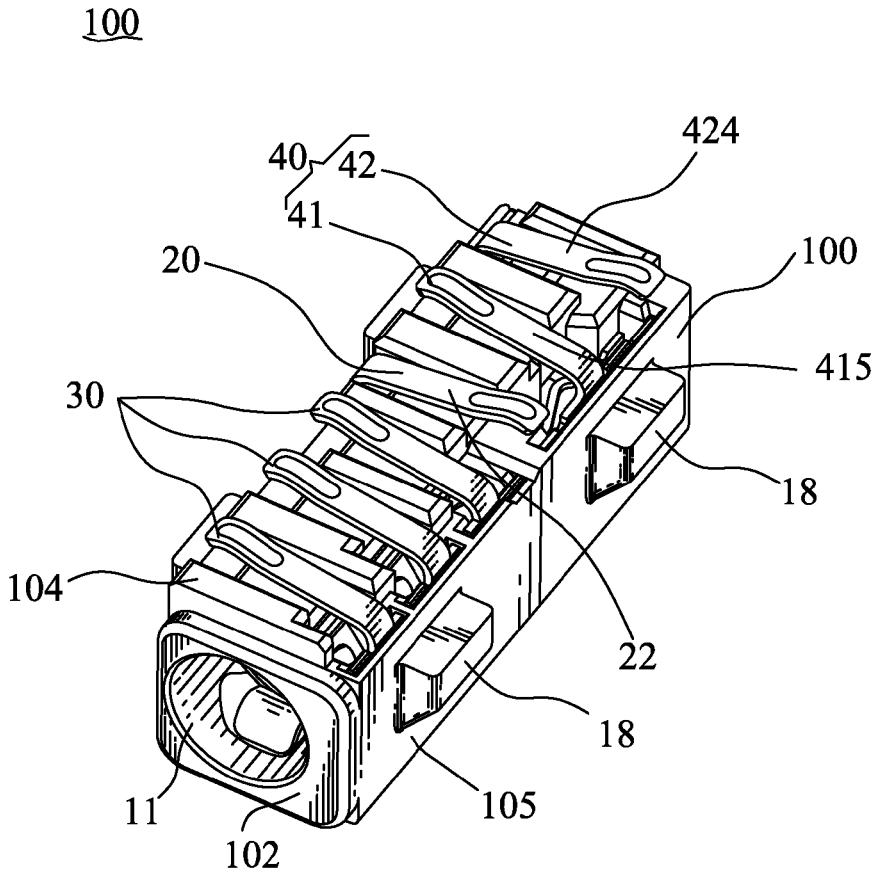
FIG. 2 is another angle perspective view of the audio jack connector shown in FIG. 1.

With reference to FIGS. 1-8, an audio jack connector 100 according to the present invention is shown. The audio jack connector 100 adapted to be electrically connected with a printed circuit board 60 and engaged with an audio plug connector 200 includes an insulating housing 10, a plurality of signal terminals 30, a ground terminal 20 and a switch terminal assembly 40.

Figure 3:
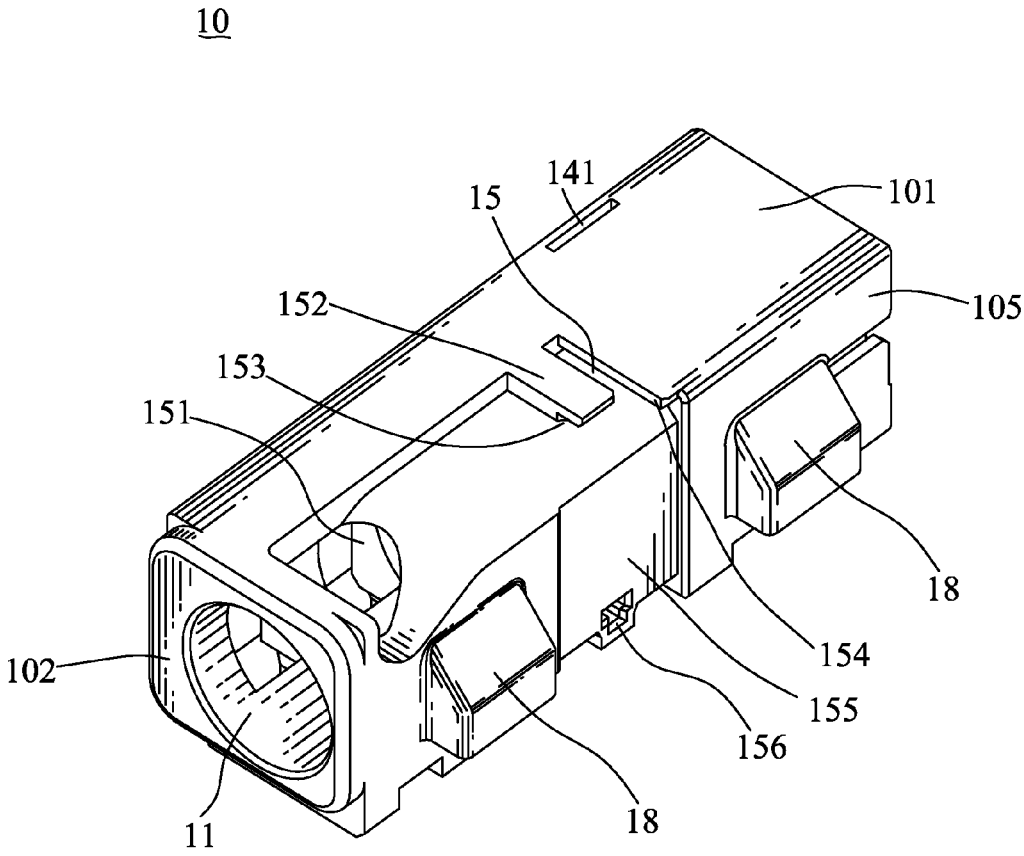
FIG. 3 is a perspective view of an insulating housing of the audio jack connector shown in FIG. 1.
Figure 4:
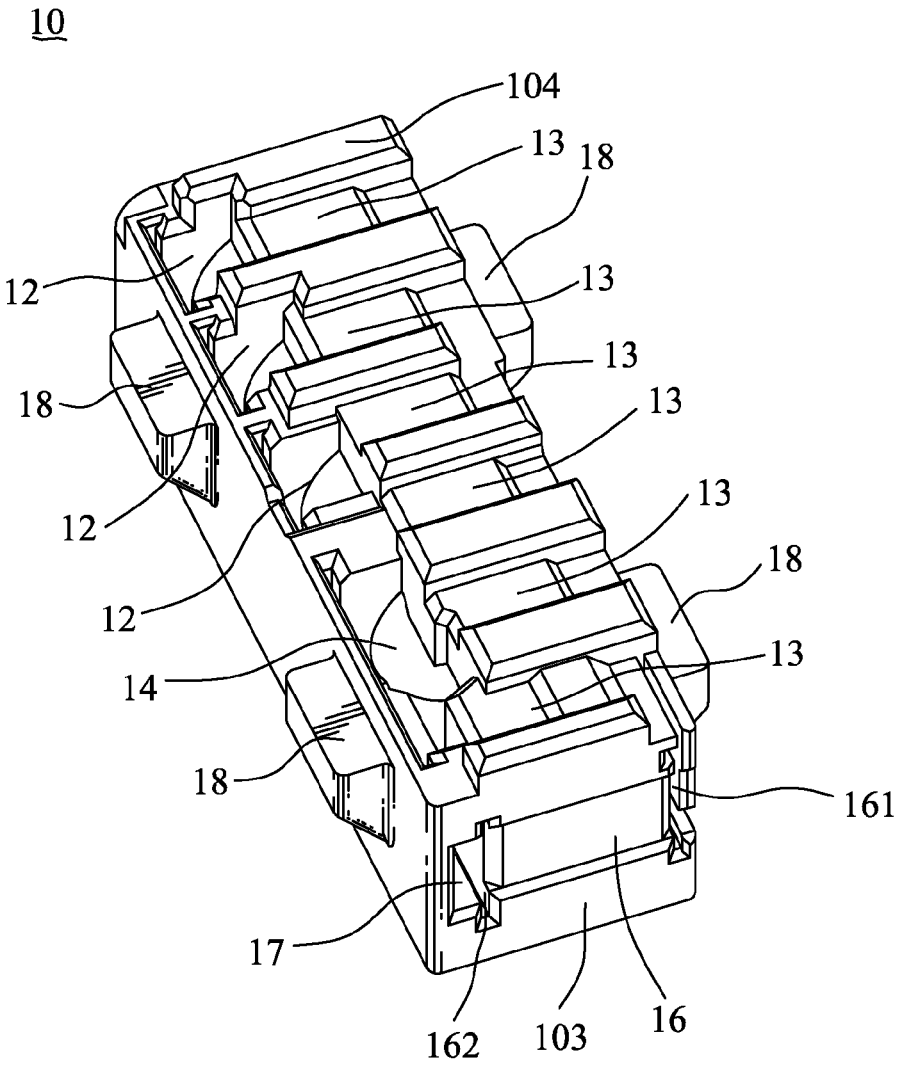
FIG. 4 is another angle perspective view of the insulating housing shown in FIG. 3.

With reference to FIGS. 3-4, the insulating housing 10 of a rectangular shape has a top surface 101, a front surface 102 perpendicular to the top surface 101, a rear surface 103 opposite to the front surface 102, a bottom surface 104 opposite to the top surface 101 and two opposite side surfaces 105. The insulating housing 10 defines a tubular insertion hole 11 extending longitudinally to penetrate through the front surface 102. The bottom surface 104 of the insulating housing 10 defines a plurality of receiving grooves 13 arranged at regular intervals along the longitudinal direction thereof and each extending along a transverse direction thereof. The insulating housing 10 defines a plurality of T-shaped first terminal cavities 12 and a T-shaped second terminal cavity 14 which are longitudinally arranged at regular intervals between one of the side surfaces 105 and the insertion hole 11 and further communicated with the insertion hole 11. The first terminal cavities 12 are successively connected with one end of one of the receiving grooves 13 from front to rear, and the second terminal cavity 14 is connected with one end of one of remaining receiving grooves 13. A top wall of the second terminal cavity 14 defines a fixing slot 141 vertically penetrating therethrough.

Referring to FIGS. 3-4 again, the insulating housing 10 defines a fastening groove 15 penetrating through a front of a side of the top surface 101 and a top of the side surface 105 adjacent to the side of the top surface 101. A front of a bottom side of the fastening groove 15 is of an arched shape and is cut off to define a gap 151 communicating with the insertion hole 11. A rear of the bottom side of the fastening groove 15 protrudes upward to form an inverted L-shaped protrusion 152 connecting with an inner sidewall of the fastening groove 15. A clipping groove 153 is formed between a free end of the protrusion 152 and the bottom side of the fastening groove 15. A rear side of the fastening groove 15 protrudes forward to form a blocking wall 154 spaced from the bottom side of the fastening groove 15. A rear of an outer side of the fastening groove 15 is spread to the side surface 105 to define a passage 155 extending vertically to penetrate through a substantial middle of the side surface 105. A bottom of an inside of the passage 155 defines a fillister 156. A bottom of the passage 155 is further spread to the bottom surface 104 to be connected with another one of the remaining receiving grooves 13. A middle of the rear surface 103 of the insulating housing 10 is concaved inward to form a recess 16 extending transversely. Two opposite ends of the recess 16 further extend forward into the insulating housing 10 to define a locating groove 161 and a buckling groove 162 which are wider than the recess 16 in height, wherein the buckling groove 162 is communicated with the second terminal cavity 14. A rear end of the second terminal cavity 14 further extends rearward to penetrate through the rear surface 103 to define an inserting groove 17 connecting with a middle of an outside of the buckling groove 162.

Each side surface 105 has two fastening ribs 18 spaced from each other for consolidating the insulating housing 10 of the audio jack connector 100 so as to increase using life of the audio jack connector 100. The two fastening ribs 18 protruded on one side surface 105 are symmetrical to the other two fastening ribs 18 protruded on the other side surface 105 to make the audio jack connector 100 conveniently and steadily fastened to an electronic product (not shown) for avoiding the audio jack connector 100 falling off the electronic product under an external force.

Figure 5:
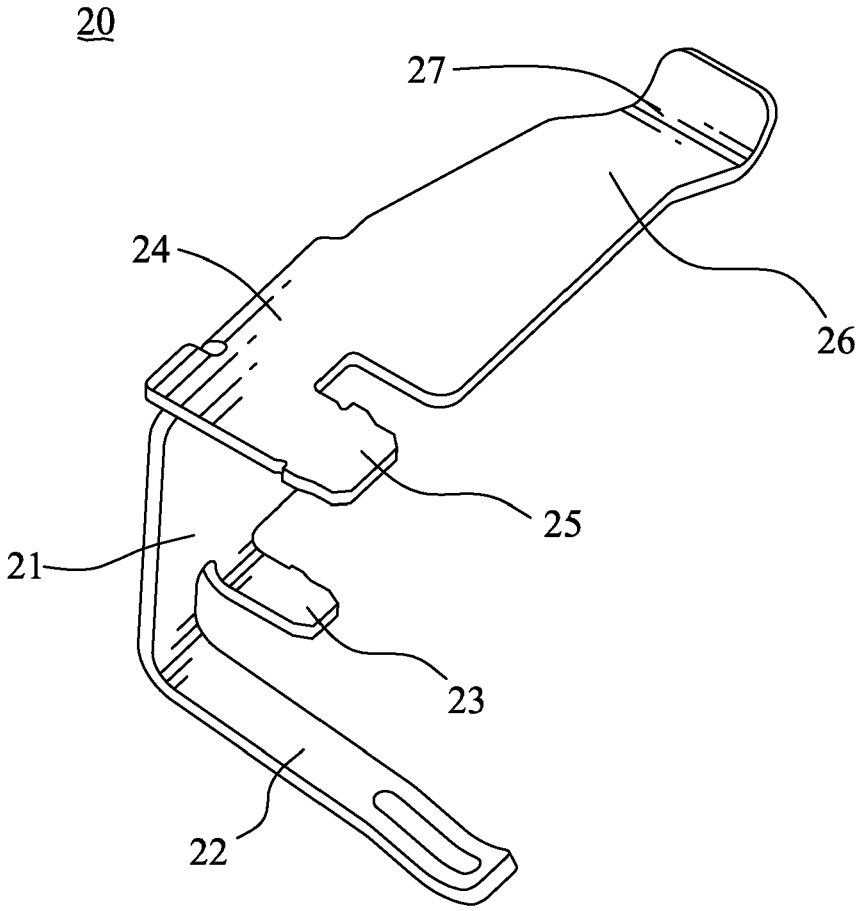
FIG. 5 is a perspective view of a ground terminal of the audio jack connector of FIG. 1.

Referring to FIG. 5, the ground terminal 20 has a rectangular base plate 21 disposed vertically. One end of a bottom edge of the base plate 21 extends towards a direction perpendicular to the base plate 21 to form a soldering arm 22 inclined downward. A portion of the bottom edge of the base plate 21 is bent towards the same direction as the extending direction of the soldering arm 22 to form an inserting piece 23 spaced from the soldering arm 22. A top edge of the base plate 21 is bent towards the same direction as the extending direction of the soldering arm 22 to form a fastening plate 24 parallel to the inserting piece 23. Two opposite side edges of the fastening plate 24 oppositely extend to form a holding plate 25 further stretched outward, and an elastic plate 26 of which a free end is arched downward to form a contact arm 27.

Figure 6:
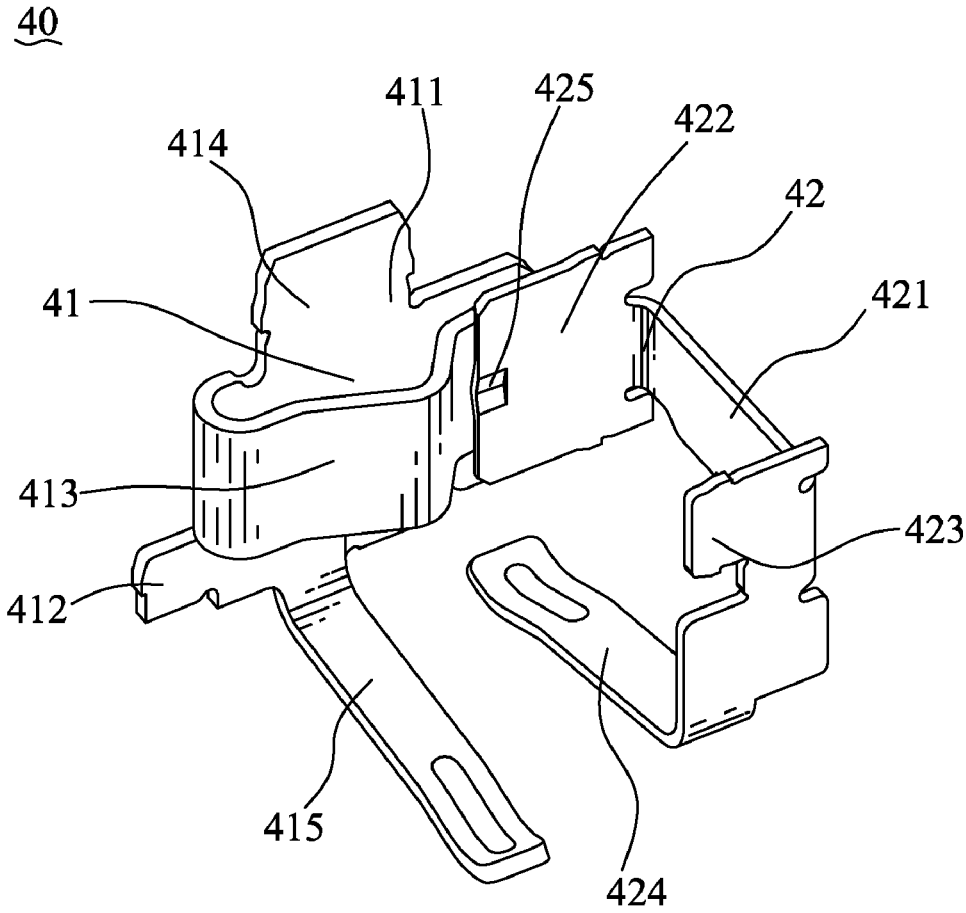
FIG. 6 is a perspective view of a switch terminal assembly of the audio jack connector of FIG. 1.

Referring to FIG. 6, the switch terminal assembly 40 includes a first switch terminal 41 and a second switch terminal 42. The first switch terminal 41 has a first base portion 411 of a rectangular board shape disposed vertically. A bottom of one end edge of the first base portion 411 extends outward to form an inserting portion 412. A first contact portion 413 is curvedly connected with a top of the one end edge of the first base portion 411 and apart faces the first base portion 411 with a substantial middle thereof being arched opposite to the first base portion 411. A top of the first base portion 411 protrudes upward to form a fixing portion 414. A bottom of the first base portion 411 extends sideward to form a first soldering portion 415 inclined downward, wherein the first soldering portion 415 is located at the same side of the first base portion 411 as the first contact portion 413. The second switch terminal 42 has a second base portion 421 of a rectangular board shape. Two opposite end edges of the second base portion 421 are bent towards the same direction perpendicular to the second base portion 421 to form a buckling portion 422 and a locating portion 423. A bottom of the locating portion 423 extends towards the buckling portion 422 and is inclined downward to form a second soldering portion 424. An outer surface of the buckling portion 422 protrudes outward to form a contact point 425.

Referring to FIGS. 1-7, in assembly, the signal terminal 30 is inserted into the respective first terminal cavity 12 of the insulating housing 10 with one end thereof stretched into the insertion hole 11 and the other end thereof suspended over the corresponding receiving groove 13. The base plate 21 of the ground terminal 20 is fastened in the passage 155 of the insulating housing 10 by virtue of the inserting piece 23 being inserted into the fillister 156. The fastening plate 24, the holding plate 25 and the elastic plate 26 of the ground terminal 20 are fastened in the fastening groove 15 by means of one side of the fastening plate 24 far away from the base plate 21 being clipped in the clipping groove 153, and the holding plate 25 being held under the blocking wall 154. The contact arm 27 of the ground terminal 20 stretches into the insertion hole 11 through the gap 151. The soldering arm 22 of the ground terminal 20 is suspended over the corresponding receiving groove 13 of the insulating housing 10.

The first base portion 411 of the first switch terminal 41 is fastened in the second terminal cavity 14 of the insulating housing 10 with a rear end thereof further stretching into the inserting groove 17, the fixing portion 414 fixed in the fixing slot 141 and the inserting portion 412 inserted in a front side of the second terminal cavity 14. The first contact portion 413 of the first switch terminal 41 is received in the second terminal cavity 14 and stretches into the insertion hole 11 with a free end thereof further stretching into the buckling groove 162. The first soldering portion 415 of the first switch terminal 41 is suspended over the corresponding receiving groove 13 of the insulating housing 10. The second base portion 421 of the second switch terminal 42 is disposed in the recess 16 of the insulating housing 10 with the buckling portion 422 buckled in the buckling groove 162 to make the contact point 425 contact with the free end of the first contact portion 413, and the locating portion 423 located in the locating groove 161. The second soldering portion 424 of the second switch terminal 42 is suspended over the corresponding receiving groove 13. Then the audio jack connector 100 is mounted on the printed circuit board 60 with the ends of the signal terminals 30 suspended over the receiving grooves 13, the soldering arm 22 of the ground terminal 20, the first soldering portion 415 of the first switch terminal 41 and the second soldering portion 424 of the second switch terminal 42 soldered on the printed circuit board 60.

Figure 7:
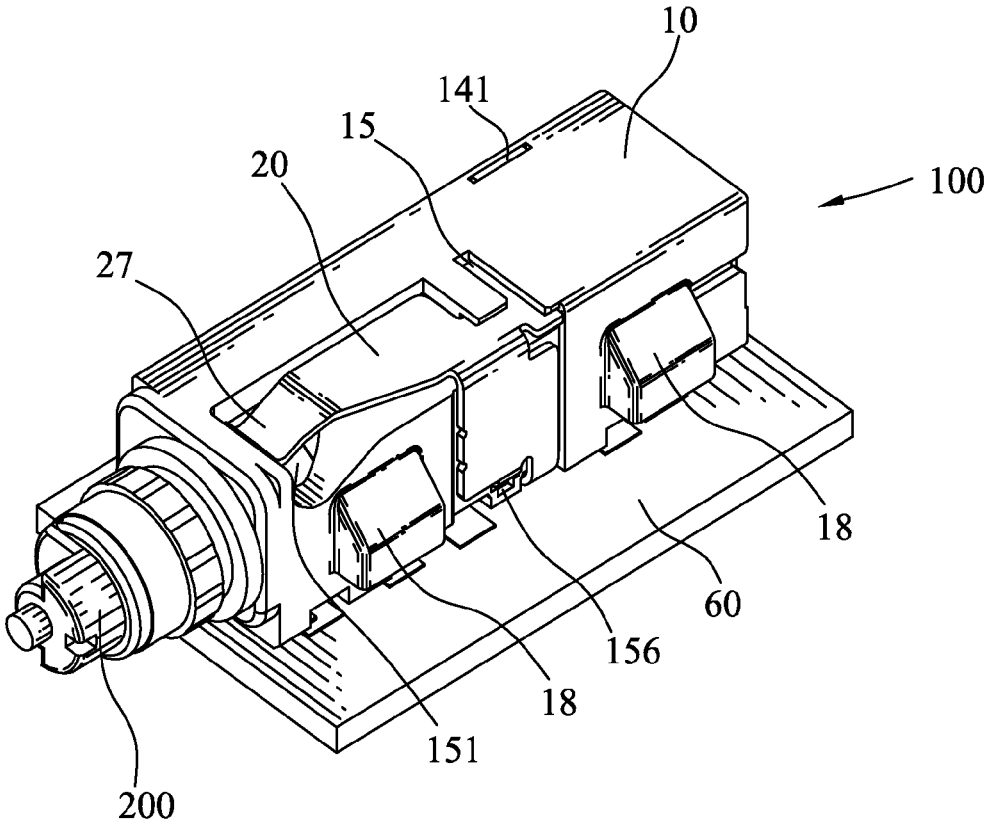
FIG. 7 is an assembly view showing that the audio jack connector shown in FIG. 1 is mounted on a printed circuit board and engaged with an audio plug connector.
Figure 8:
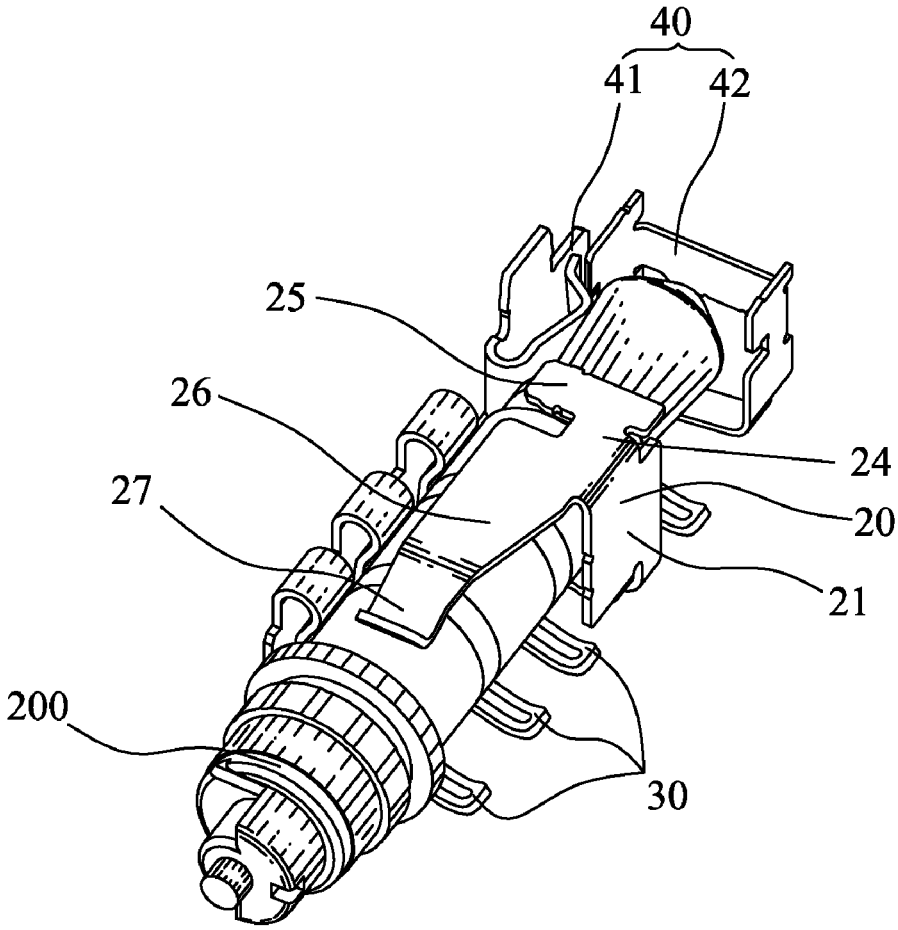
FIG. 8 is an assembly view of the audio jack connector engaged with the audio plug connector shown in FIG. 7 except the insulating housing of the audio jack connector.

With reference to FIG. 7 and FIG. 8, when the audio plug connector 200 is inserted in the audio jack connector 100, the ends of the signal terminals 30 stretched into the insertion hole 11, the contact arm 27 of the ground terminal 20, and the first contact portion 413 of the first switch terminal 41 electrically contact the audio plug connector 200. The first contact portion 413 of the first switch terminal 41 is compressed by the audio plug connector 200 to slant towards the first base portion 411 so as to make the free end of the first contact portion 413 depart from the contact point 425 of the second switch terminal 42 to realize a switching function of the switch terminal assembly 40.

As described above, the signal terminals 30, the ground terminal 20 and the switch terminal assembly 40 are arranged in a periphery portion of the insulating housing 10 to make the audio jack connector 100 have a compact structure and occupy a small space. Furthermore, the design of the ground terminal 20 realizes lower impedance and higher steadiness, and a smaller space of the ground terminal 20 occupying in the insulating housing 10.

What is claimed is:

1. An audio jack connector adapted to be electrically connected with a printed circuit board and engaged with an audio plug connector, comprising:

an insulating housing having a top surface, a front surface, a rear surface, a bottom surface and two side surfaces, the insulating housing defining an insertion hole extending along an inserting direction of the audio plug connector to penetrate through the front surface, and a fastening groove opened in the top surface, a front of a bottom side of the fastening groove defining a gap communicating with the insertion hole;

a plurality of signal terminals disposed at regular intervals between one of the side surfaces and the insertion hole of the insulating housing along the inserting direction of the audio plug connector, and each having one end stretched into the insertion hole to contact the audio plug connector and the other end suspended under the bottom surface of the insulating housing to be connected with the printed circuit board; and a ground terminal having a base plate vertically fastened in one side surface of the insulating housing, a bottom edge of the base plate extending sideward and inclined downward to form a soldering arm projected under the bottom surface to be connected with the printed circuit board, a top edge of the base plate being bent sideward to form a fastening plate of which a front edge extends forward to form an elastic plate having a front end thereof arched downward to form a contact arm, the fastening plate and the elastic plate being disposed in the fastening groove with the contact arm stretched into the insertion hole through the gap to contact the audio plug connector.

2. The audio jack connector as claimed in claim 1, wherein a rear side of the fastening groove of the insulating housing protrudes forward to form a blocking wall spaced from the bottom side of the fastening groove, a rear edge of the fastening plate of the ground terminal extends rearward to form a holding plate held under the blocking wall.

3. The audio jack connector as claimed in claim 2, wherein a rear of the bottom side of the fastening groove protrudes upward to form an inverted L-shaped protrusion connecting with an inner sidewall of the fastening groove away from the base plate, a clipping groove is formed between a free end of the protrusion and the bottom side of the fastening groove for clipping one side of the fastening plate far away from the base plate therein.

4. The audio jack connector as claimed in claim 1, wherein a rear of an outer side of the fastening groove is spread to the one side surface of the insulating housing to define a passage vertically penetrating through the one side surface with a fillister opened in a bottom of an inside thereof, a portion of the bottom edge of the base plate of the ground terminal is bent towards the same direction as the extending direction of the soldering arm to form an inserting piece spaced from the soldering arm, the base plate is fastened in the passage by virtue of the inserting piece being inserted in the fillister.

5. The audio jack connector as claimed in claim 1, wherein the two side surfaces of the insulating housing oppositely protrude outward to symmetrically form two pairs of two fastening ribs.

6. The audio jack connector as claimed in claim 1, further comprising a switch terminal assembly which includes a first switch terminal and a second switch terminal assembled in a rear of the insulating housing and cooperating with each other to monitor the insertion of the audio plug connector.

7. The audio jack connector as claimed in claim 6, wherein the first switch terminal has a first base portion assembled in one side of the rear of the insulating housing, a first contact portion is curvedly connected with a front edge of the first base portion and apart faces the first base portion with a substantial middle thereof being arched into the insertion hole of the insulating housing for being biased by the audio plug connector to depart from the second switch terminal, a bottom of the first base portion extends sideward and is inclined downward to form a first soldering portion suspended under the bottom surface of the insulating housing to be connected with the printed circuit board.

8. The audio jack connector as claimed in claim 6, wherein the second switch terminal has a second base portion disposed in the rear surface of the insulating housing, two opposite end edges of the second base portion are bent forward to form a buckling portion disposed in one side of the rear of the insulating housing with a contact point protruded thereon for electrically connecting with the first switch terminal, and a locating portion disposed in the other side of the rear of the insulating housing, a bottom of the locating portion extends sideward to form a second soldering portion suspended under the bottom surface of the insulating housing to be connected with the printed circuit board.

* * * * *